US005812919A

United States Patent [19]

Takano et al.

[11] Patent Number: 5,812,919

[45] Date of Patent: Sep. 22, 1998

[54] IMAGE TRANSFERRING DEVICE FOR AN IMAGE FORMING APPARATUS

[75] Inventors: Satoshi Takano, Tokyo; Itaru Matsuda, Yokohama; Yuko Hayama, Kawasaki; Hirokazu Ishii, Tokyo; Akio Kutsuwada, Kawasaki; Haruji Mizuishi, Tokyo; Hiroshi Itoh, Zama, all of Japan

[73] Assignee: Ricoh Company, Ltd., Tokyo, Japan

[21] Appl. No.: 596,861

[22] Filed: Feb. 9, 1996

[30] Foreign Application Priority Data

| | | | |
|---|---|---|---|
| Feb. 10, 1995 | [JP] | Japan | 7-022968 |
| Feb. 10, 1995 | [JP] | Japan | 7-022969 |
| Feb. 10, 1995 | [JP] | Japan | 7-022970 |
| Feb. 2, 1996 | [JP] | Japan | 8-017503 |

[51] Int. Cl.[6] ..... G03G 15/14; G03G 21/00

[52] U.S. Cl. ..... 399/312; 399/313; 399/346

[58] Field of Search ..... 399/312, 313, 399/297, 388, 346

[56] References Cited

U.S. PATENT DOCUMENTS

| | | | |
|---|---|---|---|
| 5,189,479 | 2/1993 | Matsuda et al. | 399/300 |
| 5,461,461 | 10/1995 | Harasawa et al. | 399/66 |
| 5,493,371 | 2/1996 | Kutsuwada et al. | 399/88 |
| 5,495,317 | 2/1996 | Marsuda et al. | 399/66 |

FOREIGN PATENT DOCUMENTS

| | | |
|---|---|---|
| 56-74283 | 6/1981 | Japan . |
| 63-129376 | 1/1983 | Japan . |
| 58-40576 | 3/1983 | Japan . |
| 3-2780 | 1/1991 | Japan . |

*Primary Examiner*—Nestor R. Ramirez

*Attorney, Agent, or Firm*—Oblon, Spivak, McClelland, Maier & Neustadt, P.C.

[57] ABSTRACT

In an image forming apparatus, a lubricant is fed to an image carrier on which a toner image is to be formed. An endless rotatable transfer member conveys a recording medium to which the toner image is to be transferred from the image carrier. The transfer member is capable of contacting the surface of the image carrier to which the lubricant has been applied. As a result, an adequate amount of lubricant is evenly applied to the transfer member to reduce the coefficient of friction of the surface of the transfer member, thereby enhancing the cleanability of the transfer member.

30 Claims, 11 Drawing Sheets

IMAGE TRANSFERRING DEVICE FOR AN IMAGE FORMING APPARATUS

BACKGROUND OF THE INVENTION

1. Field of the Invention

The present invention relates to a copier, printer, facsimile apparatus or similar electrophotographic image forming apparatus.

2. Discussion of the Background

It is a common practice with an image forming apparatus to transfer a toner image from a photoconductive element or image carrier to a paper or similar recording medium by an image transferring device using a charger. There has recently been developed an image transferring device using a so-called transfer belt. This type of device is capable of effecting ozoneless and stable image transfer and paper separation. A preselected bias is applied to the transfer belt so as to deposit charge opposite in polarity to a toner on the surface of the belt. As a result, a toner image formed on the photoconductive element is transferred to a paper.

The problem with the above transfer belt scheme is that the belt directly contacts the photoconductive element during, e.g., the interval between consecutive papers. Hence, when the background area of the photoconductive element is noticeably contaminated by the toner, the toner is transferred to a rear of the paper by way of the belt and contaminates it. This kind of contamination of the paper is critical in an automatic duplex copy mode. Therefore, the belt, like the photoconductive element, must be cleaned in order to remove the toner deposited thereon. For this purpose, use is generally made of a cleaning blade.

Japanese Utility Model Laid-Open Publication No. 58-7391, for example, proposes to apply a preselected amount of lubricant to the photoconductive element. The lubricant reduces the frictional resistance of the surface of the photoconductive element and thereby enhances the cleanability of the element. Specifically, when the surface of the photoconductive element is cleaned, the coefficient of friction of the surface is reduced so as to reduce the friction acting between the above surface and the cleaning blade. As a result, the wear of the surface of the photoconductive element and cleaning blade ascribable to friction acting therebetween is reduced. A device for applying the lubricant to the photoconductive element is fixed in place relative to the element and applies it to the element by a constant amount.

While the above lubricant scheme is mainly directed toward the improvement in the cleanability of the photoconductive element, enhancing the cleanability of the previously mentioned transfer belt is also an important consideration.

The toner contains a lubricant and serves to reduce the frictional resistance. However, the toner scarcely deposits on non-image zones existing at opposite edges of the transfer belt in the widthwise direction of the belt. Hence, if a blade is abutted against the belt in the counter direction in order to clean it, the blade shaves a layer coating the surface of the belt and thereby increases the coefficient of friction. This causes the opposite end portions of the blade to warp in the direction of rotation of the belt, resulting in defective cleaning.

Further, paper dust and toner deposited on the belt deteriorate the ability of the lubricant applying device. In addition, while the lubricant should generally be applied to the photoconductive element in a minimum necessary amount, the prior art lubricant scheme stated previously does not give any consideration to the amount of application.

SUMMARY OF THE INVENTION

It is therefore an object of the present invention to provide an image transferring device for an image forming apparatus and capable of applying an adequate amount of lubricant evenly to a transfer belt so as to reduce the coefficient of friction of the surface of the belt, thereby stably enhancing the cleanability of the belt.

In accordance with the present invention, an image forming apparatus has an image carrier for carrying a toner image thereon, a lubricant feeding device for feeding a lubricant to the image carrier, and an endless rotatable transfer member for conveying a recording medium to which the toner image is to be transferred from the image carrier, and for contacting the surface of the image carrier to which the lubricant has been fed.

Also, in accordance with the present invention, an image forming apparatus has an image carrier for carrying a toner image thereon, an endless rotatable transfer member for conveying a recording medium to which the toner image is to be transferred from the image carrier, and for contacting the surface of the image carrier, and a lubricant feeding device for feeding a lubricant to the surface of the transfer member.

Further, in accordance with the present invention, an image forming method has the steps of causing an image carrier to rotate in response to an image formation start command, and causing a lubricant feeding device to feed a lubricant to the image carrier, causing a moving device to bring an endless transfer member into contact with the image carrier being rotated, and causing the lubricant to be transferred from the image carrier directly to the surface of the transfer member before the transfer of a toner image from the image carrier to a recording medium which is conveyed by the transfer member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
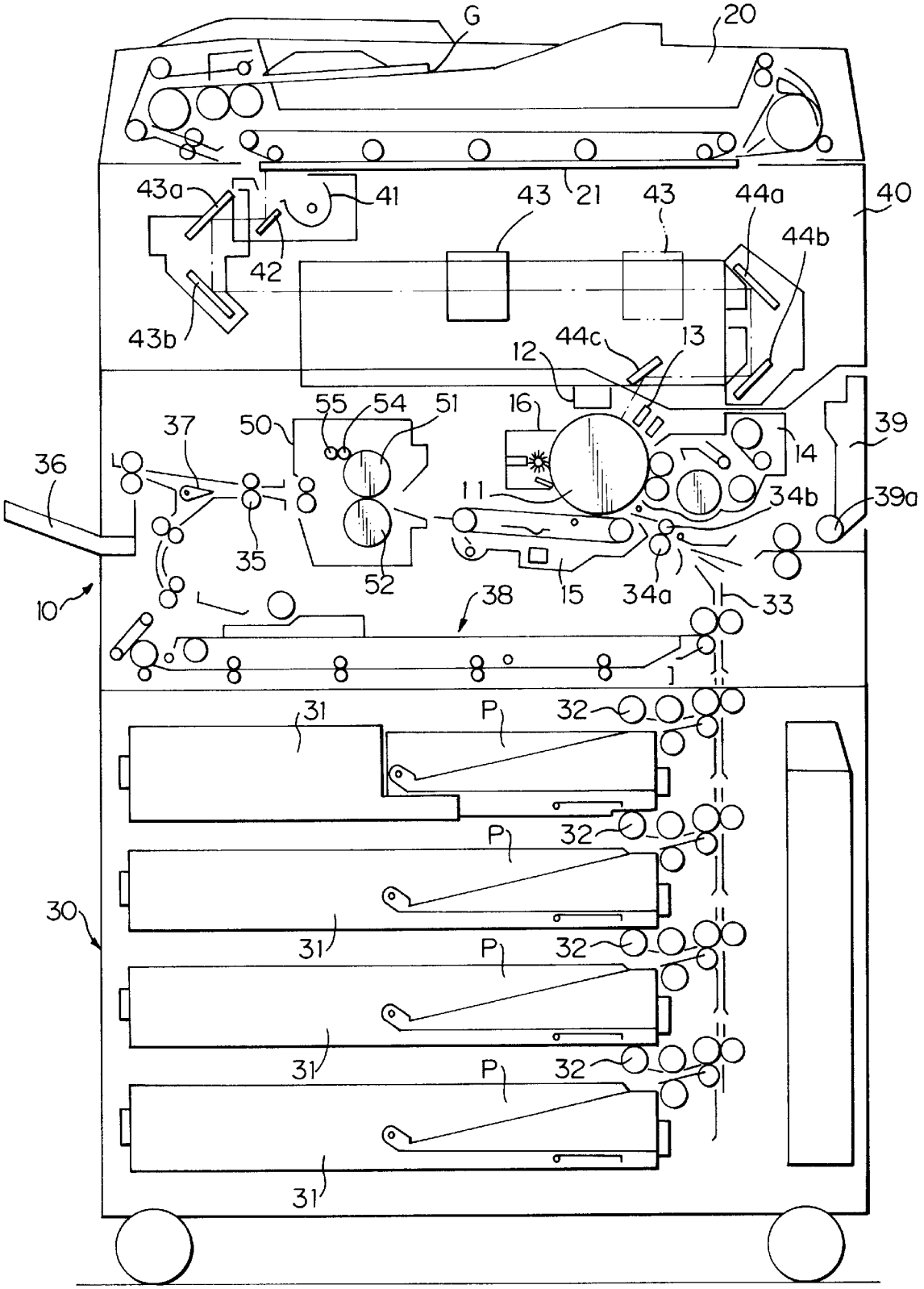
FIG. 1 is a section showing an image forming apparatus embodying the present invention.

Referring to FIG. 1 of the drawings, an image forming apparatus embodying the present invention is shown and includes a body 10. An ADF (Automatic Document Feeder) 20 is mounted on the top of the body 10 for conveying a document G from a stacking position to an image reading position. The reference numeral 30 designates a paper feeding device.

The body 10 has a photoconductive element or image carrier 11 in the form of a drum. An exposing device 40 electrostatically forms a latent image on the drum 11 by illuminating it imagewise. A charger 12 uniformly charges the surface of the drum 11. An eraser 13 erases charge deposited on the non-image areas of the drum 11. A developing device 14 develops the latent image to produce a corresponding toner image. An image transferring device 15 transfers the toner image from the drum 11 to a paper or similar recording medium P and conveys the paper P to a fixing device 50. The fixing device 50 fixes the toner image on the paper P by heating it. A cleaning unit or cleaner 16 removes the toner remaining on the drum 11 after the image transfer.

The exposing device 40 has a lamp 41 for illuminating the document G conveyed to a glass platen 21 by the ADF 20. A mirror 42 reflects the resulting reflection from the document G. A pair of mirrors 43*a* and 43*b*, a lens 43 and mirrors 44*a*, 44*b* and 44*c* are movable at a speed one half of the speed at which the mirror 42 is movable.

In the illustrative embodiment, the charger 12 charges the surface of the drum 11 to −800 V. The developing device 14 develops the latent image by depositing a toner charged to a positive polarity thereon. The paper feeding device 30 has a plurality of paper cassettes 31. The paper P is fed from one of the cassettes 31 to a transport path 33 by a pick-up roller 32 associated with the cassette 31. A pair of registration rollers 34*a* and 34*b* are arranged on the transport path 33 upstream of the image transferring device 15 with respect to the direction of paper transport. A manual feed tray 39 may be pulled out of the body 10 about a shaft 39*a*.

The fixing device 50 has a pair of fixing rollers 51 and 52, a cleaning roller 54 contacting the roller 51 which will face the toner transferred to the paper P, and a back-up roller 55 contacting the roller 54. A discharge roller pair 35 and a stack tray 36 are located downstream of the fixing device 50 with respect to the direction of paper transport. A path selector 37 is positioned just after the discharge roller pair 35 in order to switch over the path which the paper P coming out of the roller pair 35 is to travel. Specifically, the path selector 37 steers the paper P into a path leading to the stack tray 36 or to a path leading to turning means 38. The turning means 38 turns over the paper P in a duplex copy mode.

Figure 2:
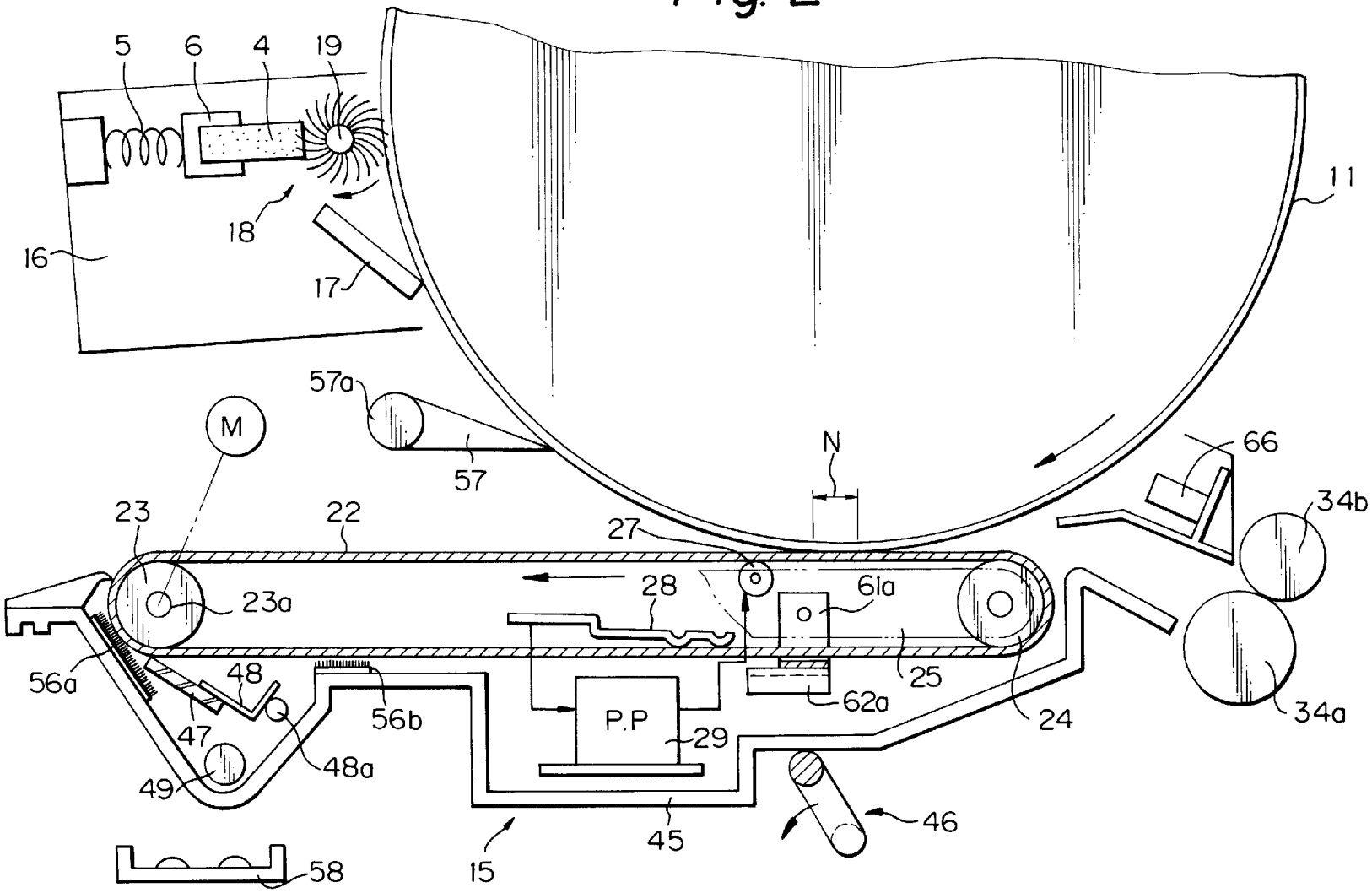
FIG. 2 is a section showing an image transferring device included in the embodiment.

As shown in FIG. 2, the cleaner 16 has a blade 17 contacting the drum 11, and a brush or lubricant feeding means 18 located downstream of the blade 17 with respect to the direction of rotation of the drum 11. The brush 18 is rotated in a direction indicated by an arrow by drive means, not shown, while contacting the surface of the drum 11. The brush 18 is made up of a cylindrical member 19 made of, e.g., aluminum, and polyester fibers implanted on the member 19. A solid lubricant 4 is pressed against the brush 18 by a compression spring 5 via a holder 6.

For the lubricant 4, use may be made of zinc stearate, barium stearate, lead stearate, iron stearate, nickel stearate, cobalt stearate, copper stearate, strontium stearate, potassium stearate, cadmium stearate, zinc oleate, manganese oleate, iron oleate, cobalt oleate, lead oleate, magnesium oleate, copper oleate, palmitic acid, cobalt zinc palmitinate, copper palmitinate, magnesium palmitinate, aluminum palmitinate, potassium palmitinate, lead caprylic acid, lead caproate, zinc linolenic acid, cobalt linolenic acid, potassium linolenic acid, cadmium colinolenic acid or similar fatty acid of relatively high order. Alternatively, use may be made of coloidal high-temperature silica powder, e.g., Cab-O-S11 (trade name) available from Capot Corporation, or carnauba was or similar natural wax.

As shown in FIG. 2, the image transferring device 15 disposed below the drum 11 has an endless belt or transfer member 22 held in contact with the drum 11 and passed over a drive roller 23 and a driven roller 24. The belt 22 is made of rubber having a medium electric resistance and scarcely variable in resistance. The surface of the belt 22 is coated with fluorine having a small coefficient of friction. For example, the belt 22 may be coated with acryl or urethane.

Figure 3:
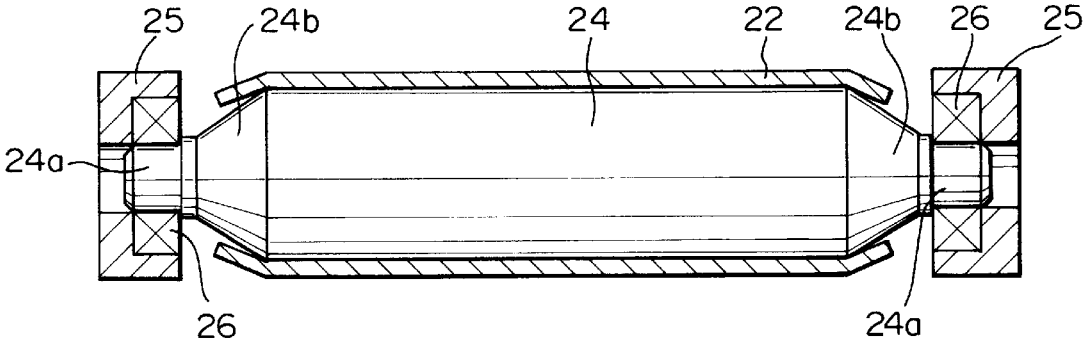
FIG. 3 is a partly sectional view of a driven roller included in the image transferring device.

As shown in FIG. 3, the driven roller 24 has tapered ends 24*b* for preventing the belt 22 from running askew. Shaft portions 24 included in the roller 24 are respectively journalled to frames 25 via bearings 26. The prevention of the skewing of the belt 22 relies on the elasticity of the belt 22 and the coefficient of friction between the belt 22 and the roller 24. Hence, when the toner, for example, is brought to between the belt 22 and the roller 24, it reduces the coefficient of friction and thereby causes the belt 22 to run askew. As a result, the rollers 23 and 24 must be cleaned in the event of replacement of the belt 22.

Referring again to FIG. 2, a bias roller 27 is held in contact with the inner periphery of the belt 22 at a position a predetermined distance apart from a nip N between the drum 11 and the belt 22 toward the drive roller 23. A ground plate 28 is also held in contact with the inner periphery of the belt 22 and spaced a predetermined distance from the bias roller 27. The bias roller 27 is made of metal and rotated by the belt 22. The ground plate 28 is also made of metal. Both the bias roller 27 and the ground plate 28 are connected to a high-tension power source 29. In the illustrative embodiment, in the event of image transfer, a voltage of −1.5 kV to −2.0 kV is applied to the bias roller 27, so that the belt 22 is charged to −1.3 kV to −1.8 kV at the nip N.

Figure 4:
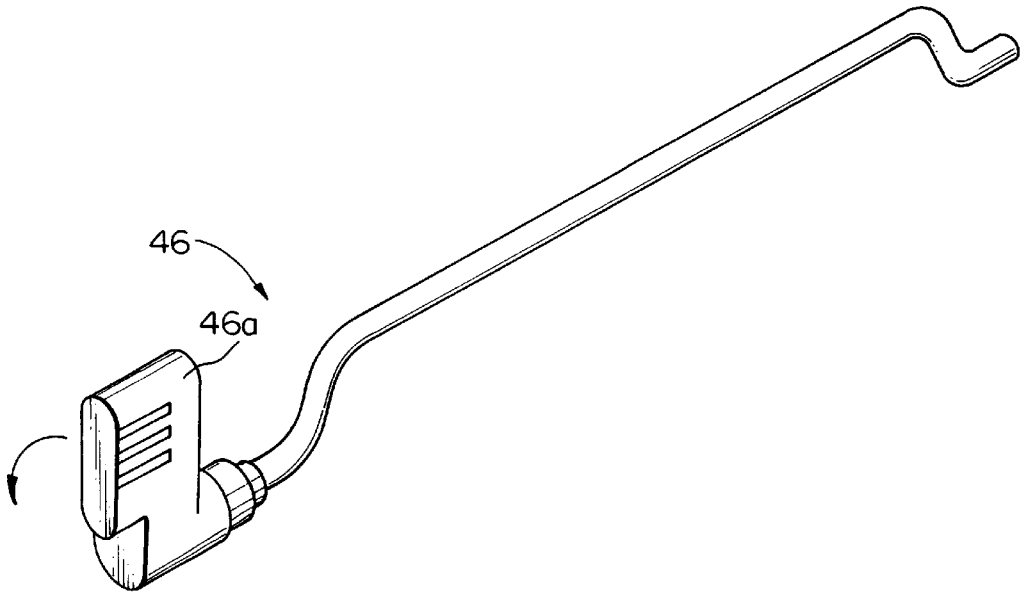
FIG. 4 is a perspective view of a press arm also included in the image transferring device.

The drive roller 23 has a shaft 23*a* journalled to opposite side walls, not shown, included in the apparatus. The bias roller 27 has its shaft journalled to the frames 25 which are supported by a casing 45 made of an insulating material. A press arm 46 is positioned below the casing 45 in order to press the image transferring device 15. As shown in FIG. 4, the press arm 46 has a crank-like configuration. The arm 46 is journalled to the side wall, not shown, at one end and provided with a release lever 46*a* at the other end. When the release lever 46*a* is turned in a direction indicated by an arrow in FIGS. 2 and 4, the image transferring device 15 is bodily rotated clockwise about the shaft 23*a*. As a result, a gap is produced between the drum 11 and the belt 22 and facilitates the removal of a jamming sheet and the attachment and detachment of the drum 11.

In a highly humid environment, the resistances of the belt 22 and paper P are lowered with the result that the charge of the belt 22 is released to the paper P. In this condition, the paper P is likely to wrap around the drum 11 due to electrostatic adhesion produced between the paper P and the drum 11. As shown in FIG. 2, the embodiment obviates such defective paper separation with a separator 57 for separating the paper P from the drum 11. The separator 57 is mounted on a shaft 57*a* and rotated by drive means, not shown, between a position where it contacts the drum 11 and a position where it is spaced from the drum 11. A dehumidifier implemented as a heater 58 is located below the image transferring device 15 and turned on and turned off in interlocked relation to a main switch, not shown, provided on the apparatus. As shown in FIG. 2, a PTL 66 lowers the potential of the surface of the drum 11 carrying the toner image thereon.

Figure 5:
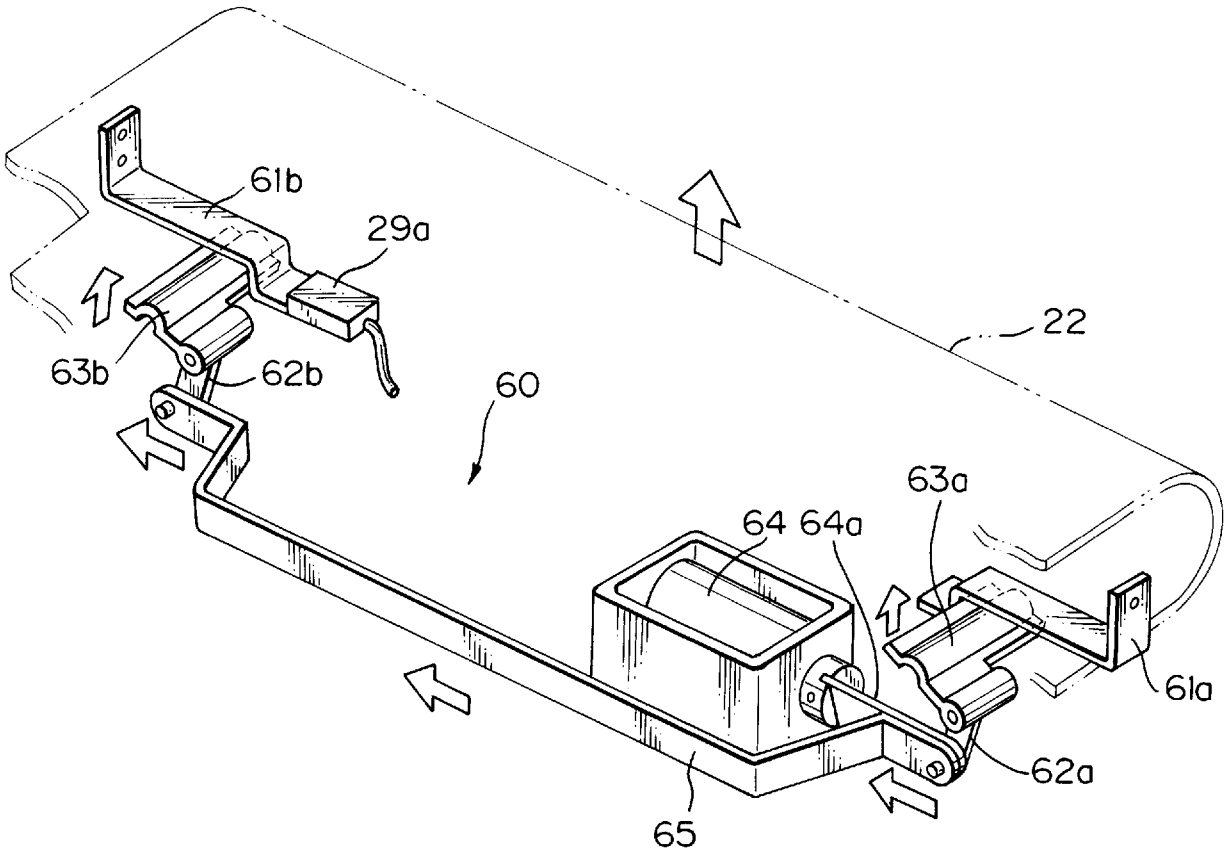
FIG. 5 is a perspective view of moving means further included in the image transferring device and for moving a transfer belt.

The belt 22 is movable between a position where it contacts the drum 11 and a position where it is spaced from the drum 11 by being driven by moving means 60 shown in FIG. 5. As shown, the moving means 60 has a pair of flexible stays 61*a* and 61*b* abutting against the underside of the belt 22, shafts 62*a* and 62*b* each being supported by a stationary member, not shown, levers 63*a* and 63*b* respectively rotatably mounted on the shafts 62*a* and 62*b*, and a solenoid 64 having a plunger 64*a* and for selectively rotating the levers 63*a* and 63*b*.

The stays 61*a* and 61*b* each have a generally L-shaped configuration and has its one end affixed to the side wall, not shown. The other end of each stay 61*a* or 61*b* is connected to the high-tension power source 29 by a connector 29*a*. The plunger 64*a* of the solenoid 64 is directly connected to the lever 63*a* and is connected to the other lever 63*b* by a connecting member 65. To reduce the load on the solenoid 64, a spring, not shown, is located at a suitable position and constantly biases the belt 22 toward the drum 11.

Figure 6:
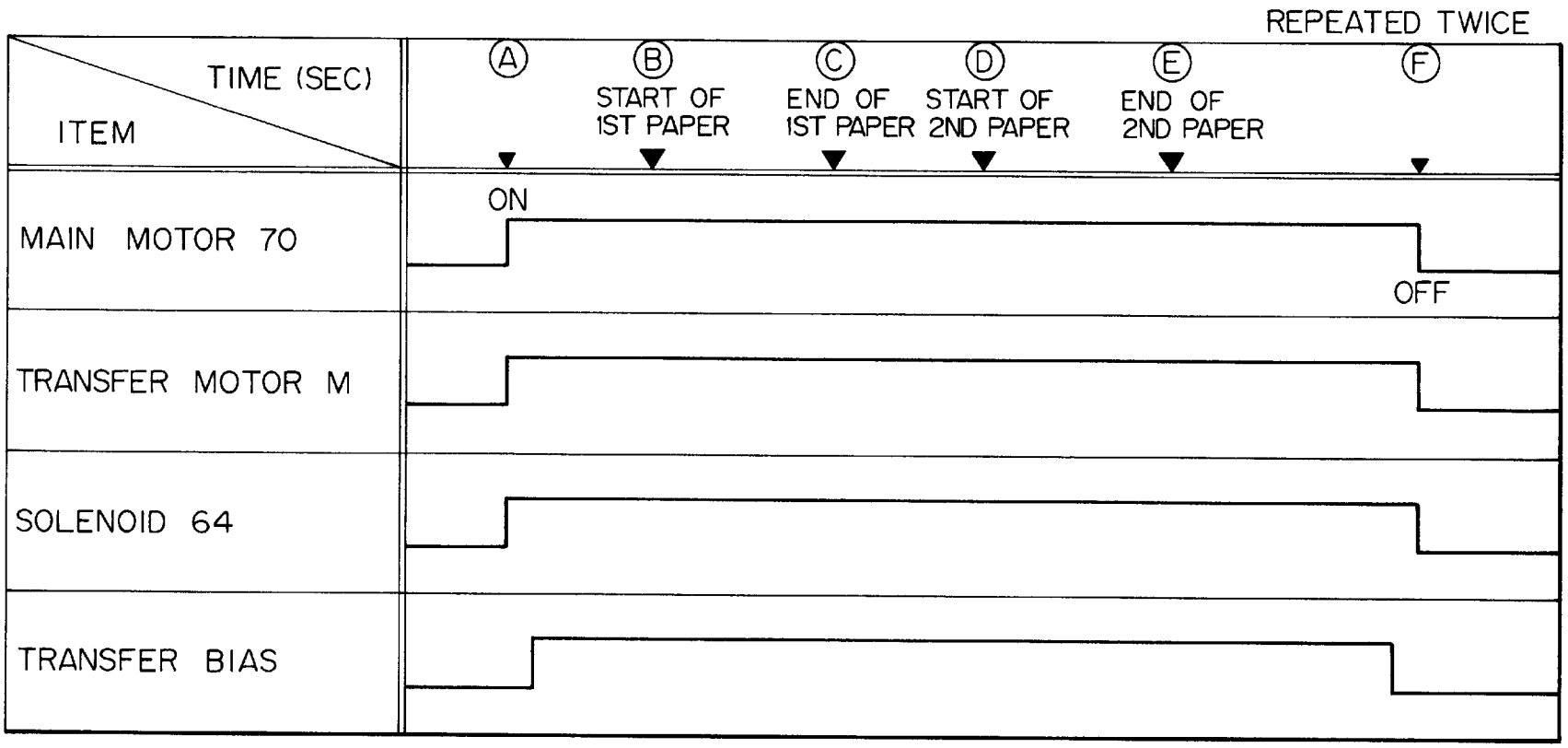
FIG. 6 is a timing chart demonstrating a specific operation of the embodiment.

The solenoid 64 is operated by control means, not shown. As shown in FIG. 6, when an operation start switch (print key) is pressed to energize a main motor 70 (ON), the solenoid 64 is also energized. Then, the plunger 64*a* is pulled into the solenoid 64, rotating the levers 63*a* and 63*b* about the shafts 62*a* and 62*b*, respectively. As a result, the flexible stays 61*a* and 61*b* are raised as indicated by arrows, causing the belt 22 to contact the drum 11. At this instant, the nip N, FIG. 2, between the belt 22 and the drum 11 is selected to be 4 mm to 8 mm wide. When the main motor 70 is deenergized (OFF) after a series of image forming operations, the solenoid 64 is also deenergized. Consequently, the belt 22 is lowered away from the drum 11 due to its own weight.

Specifically, in FIG. 6, the belt 22 is brought into contact with the drum 11 at a time A due to the turn-on of the operation start switch (print key). The leading edge of the first paper P arrives at the nip N (image transfer position) between the belt 22 and the drum 11 at a time B. The trailing edge of the first paper P moves away from the nip N at a time C. In a repeat copy mode, the leading edge of the second paper P arrives at the nip N at a time D. The trailing edge of the second paper P moves away from the nip N at a time E. At a time F, a sequence of image forming operations ends, and the belt 22 is released from the drum 11.

The interval between the times A and B, the interval between the times C and D, and the interval between the times E and F will be be referred to as non-image transfer periods or non-paper pass periods hereinafter. The interval A-B begins when an operation start command is input, i.e., when the belt 22 contacts the drum 11, and ends when the leading edge of the first paper P arrives at the nip N. The interval C-D (interval between consecutive papers) begins when the trailing edge of the first paper P moves away from the nip P, and ends when the leading edge of the second paper P arrives at the nip N. The interval E-F begins when the trailing edge of the last paper P moves away from the nip N, and ends when the belt 22 is released from the drum 11. The areas of the drum 11, as seen in the direction of rotation, corresponding to the non-image transfer periods or non-paper pass periods will be referred to as non-image areas.

The interval E-F should preferably be a preselected period of time necessary for the belt 22 to complete one or more rotations. This allows the lubricant 4 to be applied to the entire periphery of the belt 22 after the image forming operations; otherwise, the lubricant 4 must be applied to the entire periphery of the belt 22 after the start of the next image forming operation, but before the image transfer. For example, it is not necessary to idle the belt 22. Hence, the first copying time is minimized.

Further, the belt 22 may be brought into contact with the drum 11 and applied with the lubricant 4 after a power switch, not shown, provided on the apparatus has been turned on, but before the apparatus becomes ready to operate, i.e., during the warm-up period of the fixing device 50. For example, when the apparatus is operated for the first time in the morning, the lubricant 4 may be applied to the entire periphery of the drum 22 during the above warm-up time. This makes it needless to apply the lubricant to the belt 22 after the start of an image forming operation, but before the image transfer, thereby minimizing the first copying time.

A drive gear, not shown, is mounted on one end of the shaft 23*a* of the drive roller 23 and held in mesh with a transfer motor M. As also shown in FIG. 6, the transfer motor M is energized at the same time as the main motor 70. The transfer motor M may drive the belt 22 at the same linear velocity as the drum 11 during the image transfer period and/or the non-image transfer period (paper pass period and/or non-paper pass period). Alternatively, the motor M may drive the belt 22 at a lower or higher linear velocity than the drum 11 during the non-image transfer period. The difference in linear velocity between the belt 22 and the drum 22 will allow the lubricant 4 applied to the drum 11 to be readily transferred to the surface of the belt 22.

As shown in FIG. 2, a blade 47 is disposed in the casing 45 at a position where it contacts the drive roller 23 via the belt 22. The blade 47 removes the toner and impurities, including paper dust, from the belt 22. The end of the blade 47 remote from the belt 22 is affixed to a holder 48. The holder 48 is rotated about a shaft 48*a* by drive means, not shown, to selectively bring the blade 47 into or out of contact with the belt 22. A screw 49 is disposed below the blade 47 in order to convey the toner scraped off by the blade 47 to a waste toner container. Seals 56*a* and 56*b* prevent the toner scraped off by the blade 47 from flying about. The blade 47, holder 48, shaft 48*a* and screw 49 constitute a cleaning device for cleaning the belt 22.

By releasing the belt 22 from the drum 11, the following advantages are achieved. The rubber constituting the belt 22 and oily components are prevented from depositing on the drum 11; the deposition would occur if the belt 22 were held in contact with the drum 11 over a long period of time. When a photosensor, not shown, senses the density of a reference toner image formed on the drum 11, the toner image is prevented from being transferred to the sensor. Further, the toner existing in the areas of the drum 11 other than the image area is prevented from being transferred to the belt 22, so that the blade 47 is free from excessive loads.

In operation, when the operation start switch (print switch) is turned on, the main motor 70 and transfer motor M, i.e., the drum 11, belt 22 and brush 18 begin to rotate. At the same time, the solenoid 64 is energized. The lubricant 4 is evenly applied to the surface of the drum 11 in an adequate amount by the brush 18. An image forming operation is executed with the drum 11 to which the adequate amount of lubricant has been applied, as follows.

Figure 7:
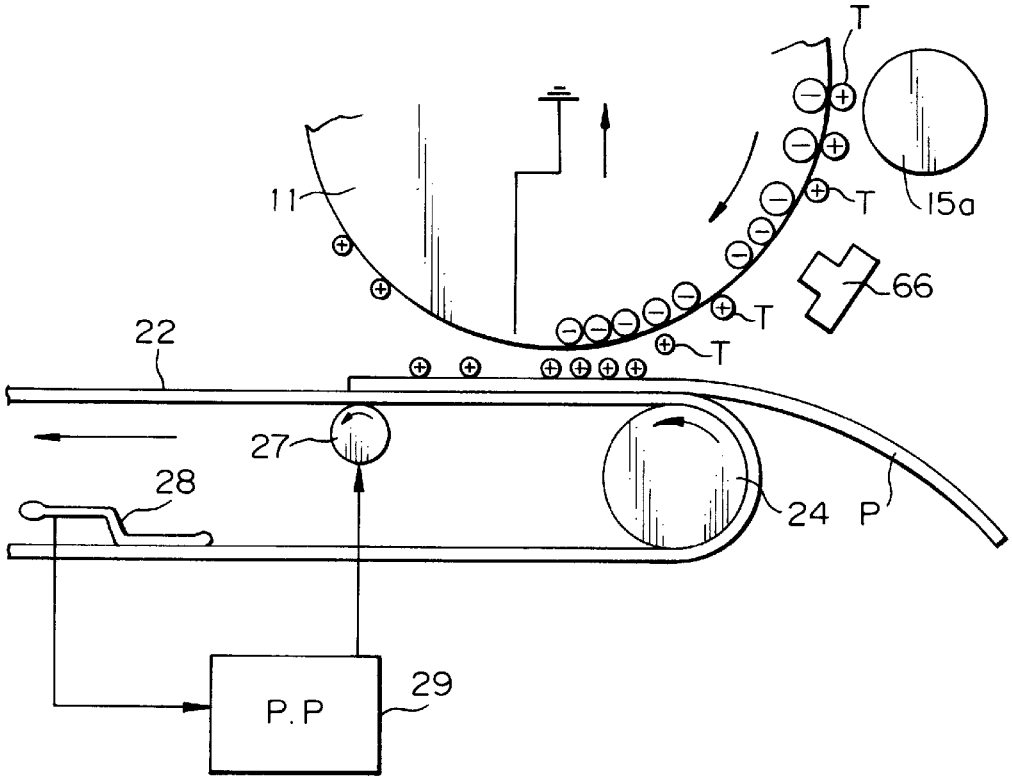
FIG. 7 shows how a toner image is transferred in the embodiment.

As shown in FIG. 1, the documents G stacked on the ADF 20 face up are sequentially fed, the bottom document G being first, to the left as viewed in FIG. 1. The document G is turned over and then conveyed to the image reading position defined on the glass platen 21. The charger 12 uniformly charges the surface of the drum 11 to −800 V. The exposing device 40 projects the image of the document G onto the charged surface of the drum 11, thereby forming a latent image. The eraser 13 erases the charge deposited on the non-image areas of the drum 11. Subsequently, as shown in FIG. 7, a developing roller 15*a* included in the developing device 14 feeds a toner T charged to the positive polarity to the latent image. As a result, the latent image is developed to turn out a toner image. Thereafter, the surface potential of the drum 11 is lowered by the PTL 66.

The paper P is fed from any one of the cassettes 31 or the manual feed tray 39 to the registration rollers 34*a* and 34*b* along the transport path 33. The rollers 34*a* and 34*b* drive the paper P such that the paper P meets at the nip N the toner image formed on the drum 11.

As shown in FIG. 5, the energized solenoid 64 pulls the plunger 64*a* and thereby causes the levers 63*a* and 63*b* to rotate about the shafts 62 and 62*b*, respectively. As a result, the stays 61*a* and 61*b* are raised to bring the belt 22 into contact with the drum 11.

During the non-image transfer period and non-paper pass period (interval between consecutive papers), the belt 22 is caused to directly contact the non-image area of the drum 11. Then, the transfer motor M is energized to rotate the belt 22. Consequently, the lubricant 4 applied to the surface of the drum 11 is transferred to the belt 22.

When the paper P arrives at the nip N, the voltage of −1.5 kV to −2.0 kV is applied from the high-tension power source 29 to the bias roller 27 so as to charge the belt 22 to −1.3 kV to −1.8 kV. As a result, as shown in FIG. 7, the toner T is transferred from the drum 11 to the paper P. At this instant, the paper P is electrostatically adhered to the belt 22 and separated from the drum 11 thereby. While the belt 22 conveys the paper P, the charge deposited on the belt 22 and paper P is sequentially dissipated by the ground plate 28. Then, the paper P is separated from the belt 22 at the drive roller 23 on a curvature basis and introduced into the fixing device 50.

In the fixing device 50, the fixing rollers 51 and 52 are heated to a preselected temperature and fix the toner T on the paper P in cooperation. The paper P with the fixed toner image is driven out to the stack tray 36. The above image forming process is repeated thereafter. A sequence of image forming operations ends when the period of time necessary for the belt 22 to complete one or more rotations elapses after the trailing edge of the last paper P has moved away from the nip N.

In a duplex copy mode, the paper P carrying the toner image on one side thereof is steered by the path selector 37 into the turning means 38 and again to the registration rollers 34*a* and 34*b*. This is followed by the above image forming process for forming an image on the rear of the paper P.

On the completion of the series of image forming operations, the main motor 70 is deenergized (OFF), and the solenoid 64 is also deenergized. As a result, the belt 22 is released from the drum 11 due to its own weight.

The toner T left on the drum 11 after the image transfer is removed by the blade 17 of the cleaner 16. Also, the toner T deposited on the belt 22 to which the lubricant 4 has been applied is removed by the blade 47 and collected in the previously mentioned container by the screw 49.

Figure 8:
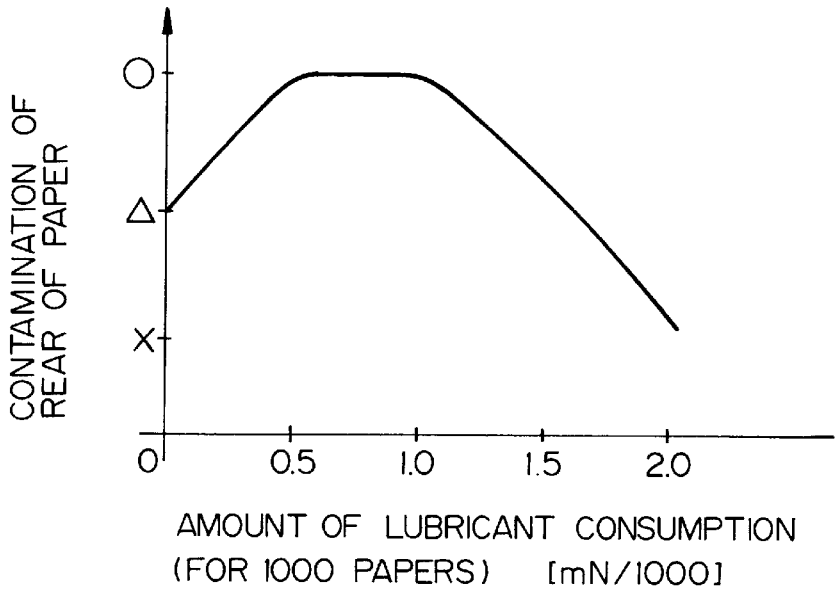
FIG. 8 is a graph showing a relation between the degree of contamination of the rear of a paper and the amount of lubricant consumption for 1,000 papers.

A series of experiments were conducted with the apparatus shown in FIG. 2 in order to determine a relation between the amount in which the lubricant 4 is applied to the drum 11, i.e., the amount of lubricant consumption, and the cleanability of the belt 22. The results of the experiments are shown in FIG. 8. The experiments were conducted in a normal temperature and normal humidity environment. The linear velocity was selected to be 430 mm/sec. The brush 18 was caused to bite 1.5 mm deep into the drum 11. The lubricant was implemented by zinc stearate.

In FIG. 8, the ordinate indicates the degree to which the rear of the paper P is contaminated, while the abscissa indicates the amount of consumption of the lubricant 4 for 1,000 papers P. Because the contamination of the paper P is ascribable to the defective cleaning of the belt 22, the ordinate shows the cleanability of the belt 22 in terms of the degree of contamination of the rear of the paper P. On the ordinate, a circle, a triangle and a cross respectively show that the rear of the paper P is free from contamination, that the contamination lies in an allowable range (invisible), and that the contamination is visible. On the abscissa, "mn/1,000" is representative of $10^3$ mN/sec. Because the amount in which the lubricant 4 is applied to the drum 11 was too small to be measured, the amount of consumption was determined by measuring the weight of the lubricant 4.

As FIG. 8 indicates, as long as the amount of consumption of the lubricant 4 is from 0.1 mN/1,000 to 15 mN/1,000 (from $1\times10^{-4}$ mN/sec to $1.5\times10^3$ mN/sec), the contamination of the paper P remains at the allowable level. When the amount of consumption ranges from 0.3 mN/1,000 to 0.8 N/1,000, the paper P is free from contamination.

Figure 9:
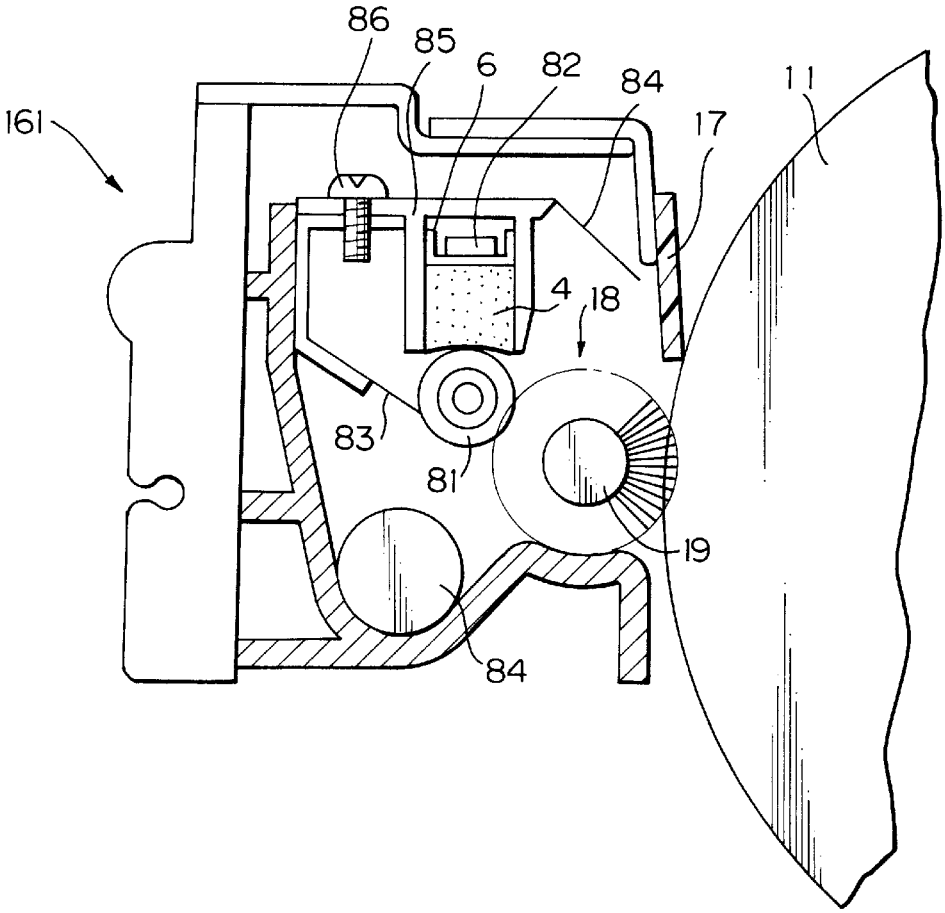
FIG. 9 is a partly sectional view of a modification of a cleaning unit included in the embodiment.

FIG. 9 shows another cleaning unit or cleaner applicable to the above embodiment. As shown, the cleaner, generally 161, differs from the cleaner 16 in that an applicator roller 81 intervenes between the lubricant 4 and the brush 18, and in that the blade 17 is located downstream of the brush 18 with respect to the direction of rotation of the drum 11. The lubricant 4 held by the holder 6 is disposed in a casing 85 which is affixed to a drum unit by a screw 86. A weight 82 is mounted on the top of the holder 6 in order to press the lubricant 4 against the applicator roller 81 with a preselected pressure. A scraper 83 is implemented by, e.g., a polyester film and held in contact with the applicator roller 81 in order to scrape off the toner deposited on the roller 81. A screw 84 is positioned below the scraper 83 in order to convey the toner scraped off by the scraper 83. The reference numeral 84 designates a Mylar seal.

Experiments were conducted with the cleaner 161 in order to determine a relation between the amount of consumption of the lubricant 4 and the number of papers P passed through the image transfer position. The experiments were conducted in a normal temperature and normal humidity environment. The linear velocity was selected to be 430 mm/sec. The amount of bite of the brush 18 into the drum 11 and the amount of bite of the same into the applicator roller 81 were selected to be 1.5 mm each. The lubricant was implemented by zinc stearate. The lubricant 4 was pressed against the applicator roller 81 by a pressure of 500 mN.

Figure 10:
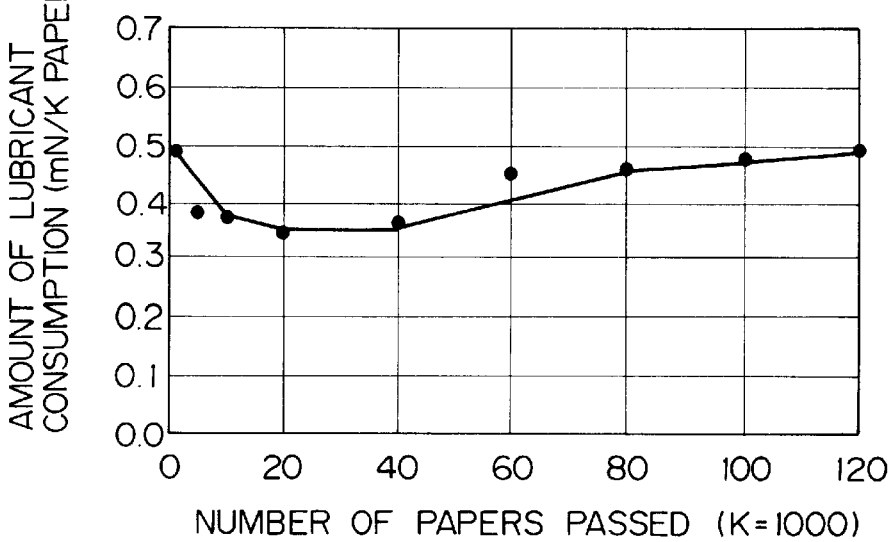
FIG. 10 is a graph showing a relation between the amount of lubricant consumption and the number of papers.

In FIG. 10, the ordinate and abscissa respectively indicate the amount of consumption of the lubricant 4 and the number of papers P. As FIG. 8 indicates, when the lubricant 4 is applied to the drum 11 by way of the applicator roller 81, the amount of application can be maintained as small as 0.3 mN/1,000 to 0.8 mN/1,000 despite aging.

When the lubricant 4 is transferred from the drum 11 to the belt 22, it smooths the coating layer of the belt 22 which usually includes cracks and undulations. This allows the blade 47 to clean the belt 22 with ease. In addition, because the lubricant 4 reduces the coefficient of friction of the surface of the belt 22, it prevents the blade 47 from being entrained by the belt 22 and reduces the wear of the blade 47 to thereby enhance durability.

As stated above, during the non-paper pass periods and non-image transfer periods and in the non-image areas of the drum 11, the embodiment holds the belt 22 in contact with the drum 11 and thereby transfers the lubricant 4 from the drum 11 to the belt 22. As a result, the coefficient of friction of the surface of the belt 22 is reduced, enhancing the cleanability of the belt 22. In addition, if the drum 11 and belt 22 are each driven at a particular linear velocity during the non-paper pass periods and non-image transfer periods, the lubricant can be efficiently transferred from the drum 11 to the belt 22.

Figure 11:
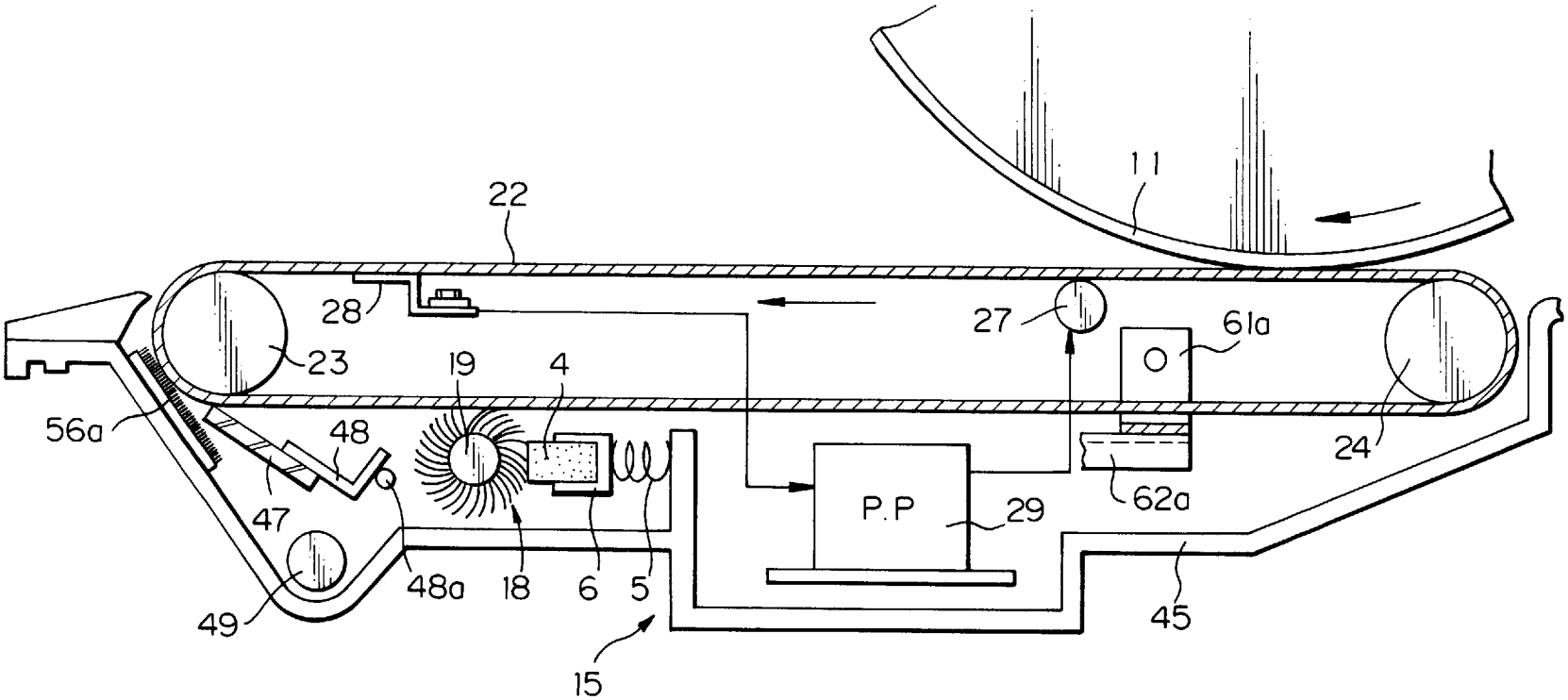
FIG. 11 is a section showing another specific configuration of the image transferring device.

FIG. 11 shows a modification of the above embodiment. As shown, the lubricant feeding means including the brush 18 and lubricant 4 is positioned just downstream of the blade 47 with respect to the direction of rotation of the belt 22. In this configuration, the lubricant 4 is constantly applied to the belt 22 by the brush 18 without regard the operation of the moving means 60.

Figure 12:
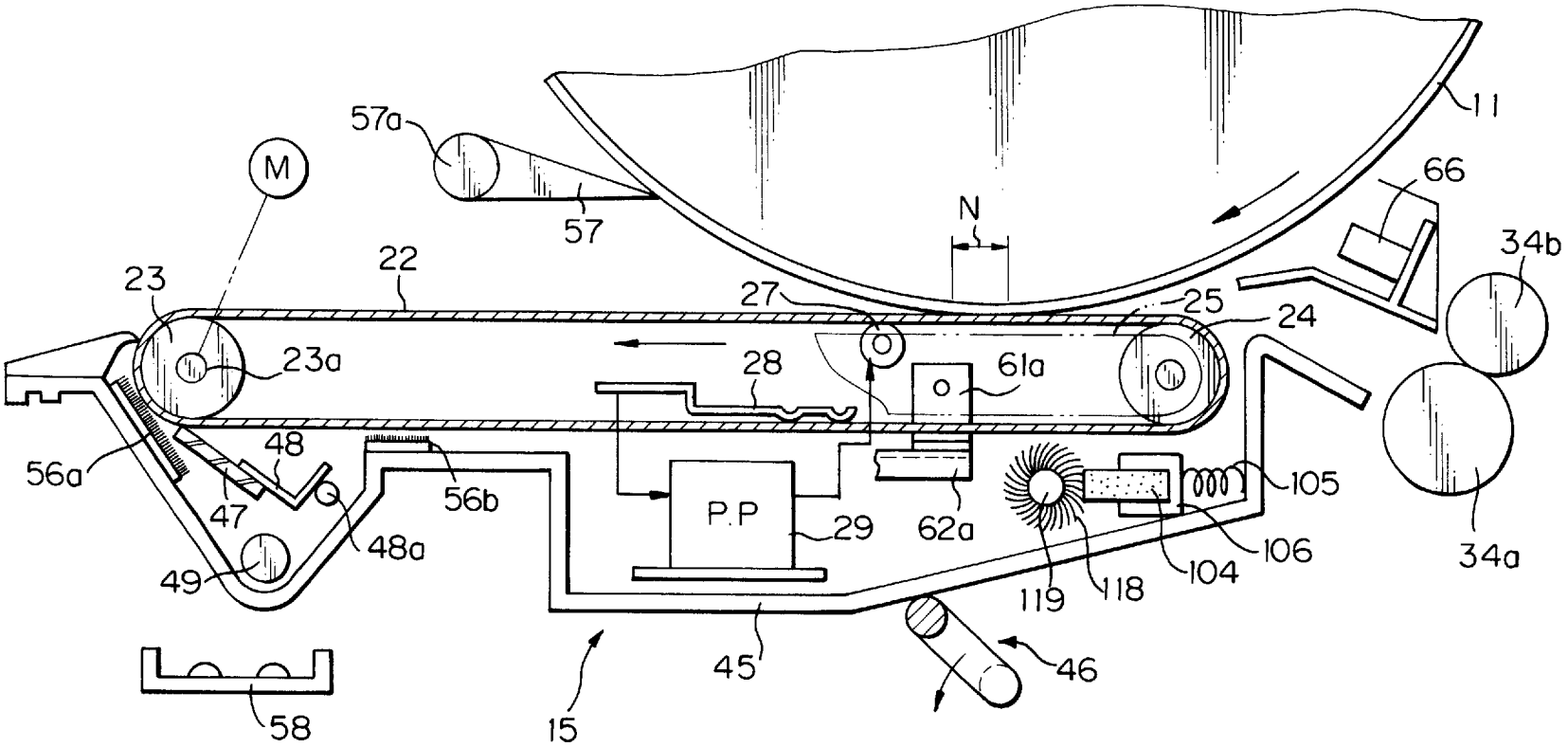
FIG. 12 is a fragmentary view showing an alternative embodiment of the present invention.

Referring to FIG. 12, an alternative embodiment of the present invention will be described. This embodiment is similar to the above embodiment except that the lubricant feeding means is located below the belt 22. In FIG. 12, the same or similar constituents as or to the constituents shown in FIG. 2 are designated by the same reference numerals, and a detailed description thereof will not be made in order to avoid redundancy.

Figure 13:
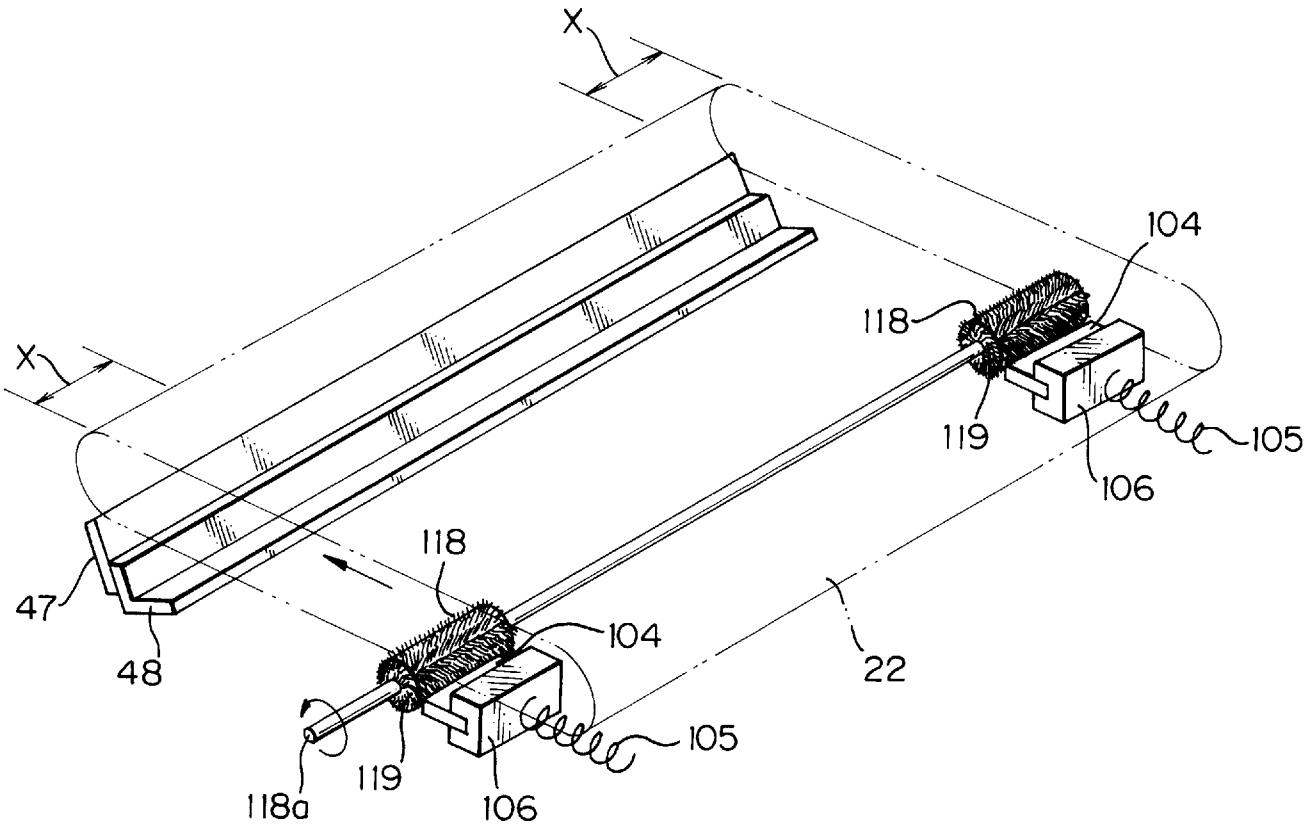
FIG. 13 is a perspective view of lubricant feeding means included in the alternative embodiment.

As shown FIG. 12, a brush 118 forming a part of the lubricant feeding means is disposed in the casing 45. The brush 118 is positioned downstream of the blade 47, but upstream of the nip N, with respect to the direction of rotation of the belt 22. Specifically, as shown in FIG. 13, two brushes 118 are located at positions corresponding to the longitudinally opposite end portions of the blade 47 or non-image zones X defined on opposite edges of the belt 22. The brushes 118 each have a cylindrical member 119 made of, e.g., aluminum and polyester fibers implanted thereon. The brushes 118 are connected together by a shaft 118*a* which is driven by drive means, not shown, in a direction indicated by an arrow in FIG. 13. Lubricants 104 are each implemented as a flat piece solidified by a binder and are held by a holder 106. The lubricants 104 are respectively pressed against the brushes 118 by compression springs 105 via the holders 106. The brushes 118 may be rotated clockwise or counterclockwise, as desired. When the brushes 118 are rotated in the opposite direction to the belt 22, the brushes 118 and belt 22 should preferably be each rotated at a particular linear velocity in order to facilitate the application of the lubricant 104 to the belt 22. The moving means 50, FIG. 5, selectively moves the belt 22 to a position where it is spaced from the brush 118, but contacts the drum 11, or to a position where it contacts the brush 118, but is spaced from the drum 11.

Figure 14:
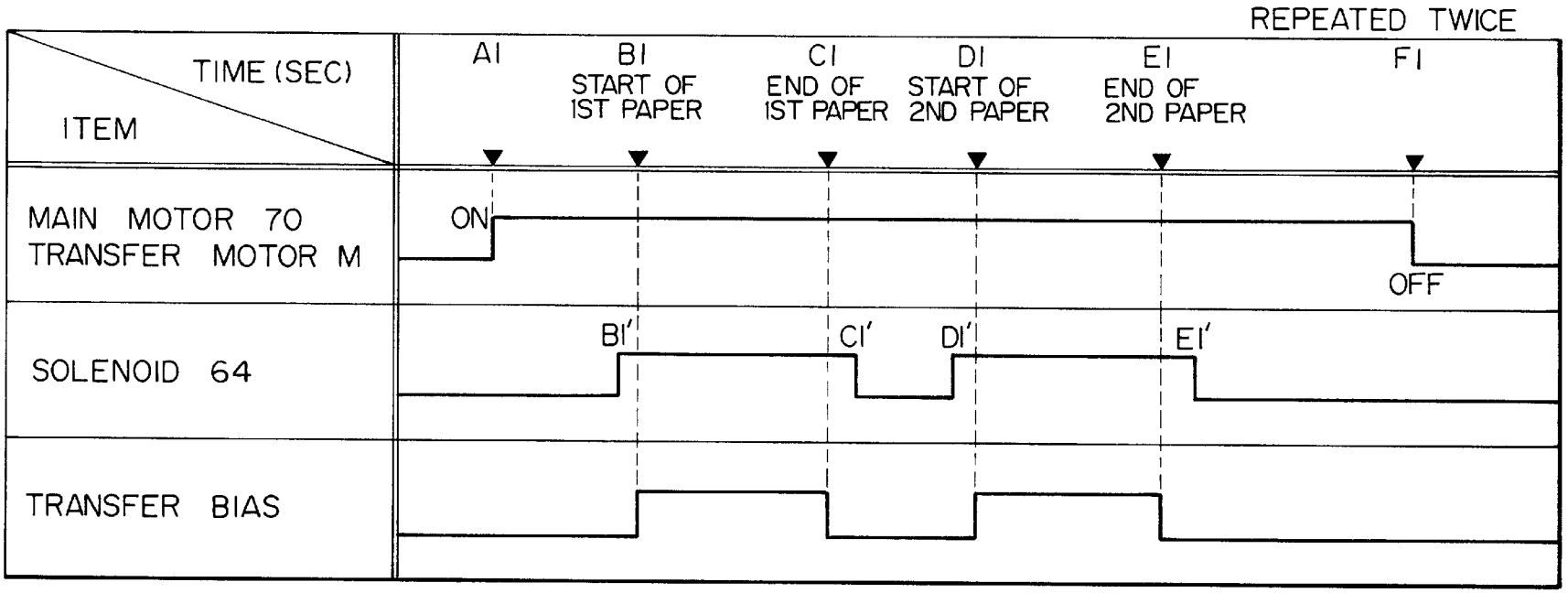
FIG. 14 is a timing chart demonstrating a specific operation of the alternative embodiment.

In this embodiment, the solenoid 64 is controlled by control means, not shown, as shown in FIG. 14. As shown, the operation start switch (print switch) is turned on at a time A1. Image transfer to the first paper P begins at a time B1 and ends at a time C1. Image transfer to the second paper P begins at a time D1 and ends at a time E1. The main motor 70 is deenergized at a time F1. Times B1', C1', D1' and E1' relating to the solenoid 64 are slightly deviated from the times B1, C1, D1 and E1, respectively. These time lags are each necessary for the belt 22 to be moved to a preselected position after the deenergization or the energization of the solenoid 64.

The interval between the times A1 and B1' will be referred to as an image formation start period (warm-up period necessary for the fixing rollers 51 and 52). The interval between the times C1' and D1' will be referred to as an image transfer end period. Further, the interval between the times D1' and E1' will be referred to as an image transfer period.

During the image transfer period, the solenoid 64 is energized to bring the belt 22 into contact with the drum 11 while releasing it from the brushes 118. During the image formation start period and image transfer end period, the solenoid 64 is deenergized to cause the belt 22 to move away from the drum 11 due to its own weight while causing it to contact the brushes 118.

In operation, when the operation start switch of the apparatus is turned on, the main motor 70 and transfer motor M are rotated to, in turn, rotate the drum 11, belt 22, and brushes 118. During the image formation start period, the belt 22 in rotation is cleaned by the blade 47. At the same time, the belt 22 is spaced from the drum 11 due to its own weight and is held in contact with the brushes 118. In this condition, an adequate amount of lubricant 104 is applied to the belt 22. Subsequently, a toner image is formed on the drum 11, as in the previous embodiment. The solenoid 64 is energized when the paper P arrives at the nip N.

As the energized solenoid 64 pulls the plunger 64*a* thereinto, the levers 63*a* and 63*b* are rotated about the shafts 62*a* and 62*b*, respectively. As a result, the stays 61*a* and 61*b* are raised and urge the belt 22 against the drum 11 while releasing it from the brushes 118. Thereafter, the toner image is transferred from the drum 11 to the paper P. After the toner image has been fixed an the paper P by the fixing device 50, the paper P is driven out to the stack tray 36.

After the image transfer to the first paper P, the solenoid 64 is deenergized with the result that the belt 22 is released from the drum 11 due to its own weight and brought into contact with the brushes 118. Hence, the lubricant 104 is applied to the surface of the belt 22. Subsequently, the toner T deposited on the belt 22 is removed by the blade 47 and then conveyed by the screw 47 to the waste toner container.

In the above embodiment, two brushes 118 are located to face the portions of the belt 22 corresponding to the longitudinally opposite ends of the blade 47 or the non-image zones X of the belt 22. Alternatively, a single brush 118 may be provided over the entire width of the belt 22.

This embodiment has the following advantages. Because the surface of the belt 22 is cleaned by the cleaning device and because an adequate amount of lubricant 104 is applied to the belt 22, the coefficient of friction of the surface of the belt 22 is reduced to enhance the cleanability of the belt 22. Because the lubricant 104 is applied to the portions of the belt 22 corresponding to the opposite ends of the blade 47, the blade 47 is prevented from warping. This further enhances the cleanability of the belt 22. The lubricant 104 is applied to the non-image zones X of the belt 22, also enhancing the cleanability of the belt 22. Because the moving means 60 selectively moves the belt 22 into or out of contact with the brushes 118 and because an adequate amount of lubricant 104 is applied to the belt 22, the coefficient of friction of the belt 22 is reduced to enhance the cleanability of the belt 22.

Further, the control means controls the moving means 60 such that the belt 22 contacts the brushes 118 before image transfer, so that the adequate amount of lubricant 104 is applied to the belt 22 beforehand. This also reduces the coefficient of friction on the surface of the belt 22 and thereby enhances the cleanability of the belt 22. In addition, because the single moving means 60 selectively moves the belt 22 into or out of contact with the brushes 118 and into or out of contact with the drum 11, the apparatus is reduced in size.

In summary, it will be seen that the present invention provides an image forming apparatus having various unprecedented advantages, as enumerated below.

(1) An adequate amount of lubricant is evenly applied to an image carrier and then to a transfer member contacting the image carrier. The lubricant reduces the coefficient of friction of the surface of the transfer member and thereby stably improves the cleanability of the transfer member.

(2) The transfer member is brought into contact with the image carrier during non-image transfer periods, non-paper pass periods, and in the non-image areas of the image carrier. This obviates the wasteful rotation of the transfer member and thereby minimizes the first copying time.

(3) When the image carrier and transfer member are each driven at a particular linear velocity during the non-image transfer periods and non-paper pass periods, the lubricant can be efficiently transferred from the image carrier to the transfer belt.

(4) If the amount of lubricant consumption is selected to be $1\times10^{-4}$ mN/sec to $1.5\times10^{-3}$ mN/sec, i.e., 0.1 mN/1,000 papers to 1.5 mN/1,000 papers, an adequate amount of lubricant is applied to the transfer belt and frees the rear of the paper from contamination.

(5) Moving means is controlled by control means in such a manner as to cause the transfer member to contact lubricant feeding means before image transfer, so that an adequate amount of lubricant is applied to the transfer member beforehand. This reduces the coefficient of friction of the surface of the transfer member and thereby enhances cleanability.

(6) A single moving means suffices for the transfer member to be selectively moved to a position where it contacts the lubricant feeding means, but is spaced from the image carrier, or to a position where it is spaced from the lubricant feeding means, but contacts the image carrier. Hence, the apparatus is small size.

(7) Because an adequate amount of lubricant is applied to the transfer member having been cleaned by a cleaning device, the coefficient of friction of the surface of the transfer member is reduced to enhance the cleanability.

(8) When the lubricant is applied to the non-image zones of the transfer member, it prevents a blade from warping and thereby improves the cleanability.

(10) The moving means selectively moves the transfer member into or out of contact with the lubricant feeding means, so that an adequate amount of lubricant is applied to the transfer member. This also reduces the coefficient of friction of the surface of the transfer member and improves the cleanability.

Various modifications will become possible for those skilled in the art after receiving the teachings of the present disclosure without departing from the scope thereof. For example, while the above embodiments have concentrated on the belt 22, the cleanability can be enhanced for all the members contacting the drum 11, e.g., a transfer roller and charge roller. Because cleanability is one of characteristic values particular to the belt, transfer roller and charge roller, the enhancement of cleanability extends the life of the apparatus. The belt 22 may be driven by the main motor 70 in place of the transfer motor M, if desired. The belt 22 is a specific form of an endless transfer member and may be replaced with a drum-like transfer medium, if desired.

What is claimed is:

1. An image forming apparatus comprising:

an image carrier for carrying a toner image thereon;

lubricant feeding means for feeding a lubricant to said image carrier; and an endless rotatable transfer member for conveying a recording medium to which the toner image is to be transferred from said image carrier, and for contacting a surface of said image carrier to which the lubricant has been fed to transfer lubricant from the said image carrier to the endless rotatable transfer member.

2. An apparatus as claimed in claim 1, further comprising moving means for selectively moving said transfer member to a position where said transfer member contacts said image carrier or to a position where said transfer member is spaced from said image carrier.

3. An apparatus as claimed in claim 2, wherein an amount of lubricant consumption of said lubricant feeding means ranges from (0.1 mN)/(1,000 recording media) to (1.5 mN)/(1,000 recording media).

4. An image forming apparatus comprising:

an image carrier for carrying a toner image thereon;

lubricant feeding means for feeding a lubricant to said image carrier;

an endless rotatable transfer member for conveying a recording medium to which the toner image is to be transferred from said image carrier, and for contacting a surface of said image carrier to which the lubricant has been fed;

an endless rotatable transfer member for conveying a recording medium to which the toner image is to be transferred from said image carrier, and for contacting a surface of said image carrier to which the lubricant has been fed;

moving means for selectively moving said transfer member to a position where said transfer member contacts said image carrier or to a position where said transfer member is spaced from said image carrier, wherein said transfer member is caused to contact said image carrier during a non-image transfer period of a non-medium pass period.

5. An apparatus as claimed in claim 4, wherein said image carrier and said transfer member are each moved at a particular linear velocity during the non-image transfer period or the non-medium pass period.

6. An apparatus as claimed in claim 4, wherein the non-image transfer period or the non-medium pass period is an interval between a start of an image forming operation and an arrival of the recording medium at an image transfer position.

7. An apparatus as claimed in claim 4, wherein the non-image transfer period or the non-medium pass period is a preselected period of time necessary for said transfer member to complete at least one rotation after a trailing edge of a last recording medium has moved away from an image transfer position.

8. An apparatus as claimed in claim 4, wherein the non-image transfer period or the non-medium pass period is an interval between a time when a power source of a body of said apparatus is turned on and a time when said apparatus becomes ready to start an image forming operation.

9. An apparatus as claimed in claim 4, wherein the non-image transfer period or the non-medium pass period is, when an image forming operation is continuously repeated with a plurality of recording media, an interval between a time when a trailing edge of a first recording medium moves away from an image transfer position and a time when a leading edge of a second recording medium arrives at the image transfer position.

10. An apparatus as claimed in claim 4, wherein the non-image transfer period or the non-medium pass period is an interval between a time when a power source of a body of said apparatus is turned on and a time when said apparatus becomes ready to start an image forming operation.

11. An imaging forming apparatus comprising:

an image carrier for carrying a toner image thereon;

lubricant feeding means for feeding a lubricant to said image carrier;

an endless rotatable transfer member for conveying a recording medium to which the toner image is to be transferred from said image carrier, and for contacting a surface of said image carrier to which the lubricant has been fed;

moving means for selectively moving said transfer member to a position where said transfer member contacts said image carrier or to a position where said transfer member is spaced from said image carrier;

wherein an amount of lubricant consumption of said lubricant feeding means ranges from $1\times10^{4}$ mN/sec to $1.5\times10^{-3}$ mN/sec.

12. An image forming apparatus comprising:

an image carrier for carrying a toner image thereon;

an endless rotatable transfer member for conveying a recording medium to which the toner image is to be transferred from said image carrier, and for contacting a surface of said image carrier; and lubricant feeding means for feeding a lubricant to a surface of said transfer member, wherein said lubricant feeding means is located at non-image zones of said transfer member.

13. An apparatus as claimed in claim 12, further comprising moving means for selectively moving said transfer member to a position where said transfer member contacts said lubricant feeding means or to a position where said transfer member is spaced from said lubricant feeding means.

14. An apparatus as claimed in claim 13, further comprising control means for controlling said moving means such that said transfer member contacts said lubricant feeding means at a start of operation of said apparatus.

15. An apparatus as claimed in claim 13, further comprising control means for controlling said moving means such that said transfer member contacts said lubricant feeding means at a start and an end of an image forming operation of said apparatus.

16. An apparatus as claimed in claim 12, further comprising a cleaning device for cleaning said transfer member, wherein said lubricant feeding means is located downstream of said cleaning device with respect to a direction of rotation of said transfer member, but upstream of a nip between said image carrier and said transfer member in said direction.

17. An apparatus as claimed in claim 16, wherein said cleaning device comprises a blade contacting said transfer member, and wherein said lubricant feeding means is located at positions of said transfer member corresponding to longitudinally opposite ends of said blade.

18. An apparatus as claimed in claim 17, further comprising moving means for selectively moving said transfer member to a position where said transfer member contacts said lubricant feeding means or to a position where said transfer member is spaced from said lubricant feeding means.

19. An apparatus as claimed in claim 12, further comprising moving means for selectively moving said transfer member to a position where said transfer member contacts said lubricant feeding means or to a position where said transfer member is spaced from said lubricant feeding means.

20. An image forming apparatus comprising:

an image carrier for carrying a toner image thereon;

an endless rotatable transfer member for conveying a recording medium to which the toner image is to be transferred from said image carrier, and for contacting a surface of said image carrier;

lubricant feeding means for feeding a lubricant to a surface of said transfer member;

moving means for selectively moving said transfer member to a position where said transfer member contacts said lubricant feeding means or to a position where said transfer member is spaced from said lubricant feeding means;

control means for controlling said moving means such that said transfer member contacts said lubricant feeding means at a start of operation of said apparatus;

wherein said moving means selectively moves said transfer member to said position where said transfer member contacts said lubricant feeding means or to said position where said transfer member is spaced from said lubricant feeding means, and selectively moves said transfer member to a position where said transfer member contacts said image carrier or to a position where said transfer member is spaced from said image carrier.

21. An apparatus as claimed in claim 20, wherein said moving means selectively moves said transfer member to a position where said transfer member contacts said lubricant feeding means, but is spaced from said image carrier, or to a position where said transfer member is spaced from said lubricant feeding means, but contacts said image carrier.

22. An image forming apparatus comprising:

an image carrier for carrying a toner image thereon;

an endless rotatable transfer member for conveying a recording medium to which the toner image is to be transferred from said image carrier, and for contacting a surface of said image carrier;

lubricant feeding means for feeding a lubricant to a surface of said transfer member;

moving means for selectively moving said transfer member to a position where said transfer member contacts said lubricant feeding means or to a position where said transfer member is spaced from said lubricant feeding means; and control means for causing said transfer member to contact said lubricant feeding means at an end of an image transfer.

23. An apparatus as claimed in claim 22, wherein said moving means selectively moves said transfer member to said position where said transfer member contacts said lubricant feeding means or to said position where said transfer member is spaced from said lubricant feeding means, and selectively moves said transfer member to a position where said transfer member contacts said image carrier or to a position where said transfer member is spaced from said image carrier.

24. An apparatus as claimed in claim 23, wherein said moving means selectively moves said transfer member to a position where said transfer member contacts said lubricant feeding means, but is spaced from said image carrier, or to a position where said transfer member is spaced from said lubricant feeding means, but contacts said image carrier.

25. An image forming apparatus comprising:

an image carrier for carrying a toner image thereon;

an endless rotatable transfer member for conveying a recording medium to which the toner image is to be transferred from said image carrier, and for contacting a surface of said image carrier;

lubricant feeding means for feeding a lubricant to a surface of said transfer member;

moving means for selectively moving said transfer member to a position where said transfer member contacts said lubricant feeding means or to a position where said transfer member is spaced from said lubricant feeding means;

control means for controlling said moving means such that said transfer member contacts said lubricant feeding means at a start and an end of an image forming operation of said apparatus;

wherein said moving means selectively moves said transfer member to said position where said transfer member contacts said lubricant feeding means or to said position where said transfer member is spaced from said lubricant feeding means, and selectively moves said transfer member to a position where said transfer member contacts said image carrier or to a position where said transfer member is spaced from said image carrier.

26. An apparatus as claimed in claim 25, wherein said moving means selectively moves said transfer member to a position where said transfer member contacts said lubricant feeding means, but is spaced from said image carrier, or to a position where said transfer member is spaced from said lubricant feeding means, but contacts said image carrier.

27. An image forming apparatus comprising:

an image carrier for carrying a toner image thereon;

an endless rotatable transfer member for conveying a recording medium to which the toner image is to be transferred from said image carrier, and for contacting a surface of said image carrier;

lubricant feeding means for feeding a lubricant to a surface of said transfer member;

moving means for selectively moving said transfer member to a position where said transfer member contacts said lubricant feeding means or to a position where said transfer member is spaced from said lubricant feeding means;

wherein said moving means selectively moves said transfer member to said position where said transfer member contacts said lubricant feeding means or to said position where said transfer member is spaced from said lubricant feeding means, and selectively moves said transfer member to a position where said transfer member contacts said image carrier or to a position where said transfer member is spaced from said image carrier.

28. An apparatus as claimed in claim 27, wherein said moving means selectively moves said transfer member to a position where said transfer member contacts said lubricant feeding means, but is spaced from said image carrier, or to a position where said transfer member is spaced from said lubricant feeding means, but contacts said image carrier.

29. An image forming apparatus comprising:

an image carrier for carrying a toner image thereon;

an endless rotatable transfer member for conveying a recording medium to which the toner image is to be transferred from said image carrier, and for contacting a surface of said image carrier; and lubricant feeding means for feeding a lubricant to a surface of said transfer member;

a cleaning device for cleaning said transfer member, wherein said lubricant feeding means is located downstream of said cleaning device with respect to a direction of rotation of said transfer member, but upstream of a nip between said image carrier and said transfer member in said direction; and moving means for selectively moving said transfer member to a position where said transfer member contacts said lubricant feeding means or to a position where said transfer member is spaced from said lubricant feeding means.

30. An image forming method comprising the steps of:

causing an image carrier to rotate in response to an image formation start command, and causing lubricant feeding means to feed a lubricant to said image carrier;

causing moving means to bring an endless transfer member into contact with said image carrier being rotated; and causing the lubricant to be transferred from said image carrier directly to a surface of said transfer member before a transfer of a toner image from said image carrier to a recording medium which is conveyed by said transfer member.

* * * * *